US005703551A

United States Patent [19]

Lefebvre et al.

[11] Patent Number: 5,703,551

[45] Date of Patent: Dec. 30, 1997

[54] STARTER CONTACTOR HAVING AN ELECTRONIC CONTROL CIRCUIT, AND A VEHICLE STARTER HAVING SUCH A CONTACTOR

[75] Inventors: Bruno Lefebvre, Villeurbanne; René Jacquet, Lyons; Jean-François Quentric, St. Bonnet de Mure, all of France

[73] Assignee: Valeo Equipements Electriquest Moteur, Creteil, France

[21] Appl. No.: 670,371

[22] Filed: Jun. 25, 1996

[30] Foreign Application Priority Data

Jun. 27, 1995 [FR] France ..... 95 07808

[51] Int. Cl.[6] ..... H01H 67/02

[52] U.S. Cl. ..... 335/126; 335/131

[58] Field of Search ..... 335/126, 131

[56] References Cited

FOREIGN PATENT DOCUMENTS 2 626 624 8/1989 France .

42 42 930 6/1994 Germany .

OTHER PUBLICATIONS

French Search Report 22 Mar. 1996.

*Primary Examiner*—Lincoln Donovan

*Attorney, Agent, or Firm*—Morgan & Finnegan LLP

[57] ABSTRACT

A motor vehicle starter system includes a contactor comprising an annular cylindrical armature and a winding which actuates a movable core in axial displacement, so that the latter acts on a control rod extending through the centre of a fixed core in the form of a disc. The control rod controls axial displacements of a movable contact, and the contactor further includes a hood having the general form of a cylindrical pot, with a skirt portion which defines a housing. The movable contact is arranged within this housing. The starter system also includes an electronic control system for the contactor, comprising a support member such as a printed circuit board, and circuit components carried by the support member.

The electronic control circuit is arranged inside the contactor.

12 Claims, 3 Drawing Sheets

STARTER CONTACTOR HAVING AN ELECTRONIC CONTROL CIRCUIT, AND A VEHICLE STARTER HAVING SUCH A CONTACTOR

FIELD OF THE INVENTION

The present invention relates to starters for motor vehicles, and in particular to contactors for such starters.

BACKGROUND OF THE INVENTION

According to one known arrangement, a contactor, forming part of the starter system for starting an internal combustion engine of a motor vehicle, comprises a cylindrical annular armature which constitutes a casing in which a winding is mounted. This winding, or coil, actuates a movable core in axial displacement. The movable core, or plunger, acts on a control rod which extends through the centre of a fixed core in the form of a disc, arranged at one of the axial ends of the armature or casing. The control rod and the movable core together control axial displacements of a movable contact, which is arranged for cooperation with a pair of fixed contact terminals that form part of the power supply circuit for the motor of the starter. These fixed contact terminals are arranged in the base portion of a hood, which has the general form of a cylindrical pot defining a skirt portion. This skirt portion defines an internal housing which contains the movable contact itself.

A known way of providing control for the contactor is to equip it with an electronic control circuit for that purpose, with this control circuit comprising a support member and appropriate electronic components carried by the support member. The support member is for example a printed circuit board.

In one known design, the electronic control circuit is disposed inside a fully sealed casing which is subsequently fixed on the outside of the starter, and in practice on the support member of the latter, or on the contactor, or on the yoke of the electric starter motor. The casing of the electronic control circuit can also be fixed on the body of the vehicle, within the engine compartment.

It is then necessary to provide wires or cables for making the necessary electrical connections between the said casing and, firstly, the starter contactor and secondly, the other parts of the vehicle that are necessary for controlling starting of the engine, for example the ignition key, an anti-theft device, an electronic computer unit for control of fuel injection, ignition, and so on.

The disposition of the electronic control circuit within an independent casing thus calls for the provision of an additional component, which is bulky and which makes it necessary to provide additional electrical connections, thus requiring additional assembly operations on the vehicle.

DISCUSSION OF THE INVENTION

An object of the invention is to overcome the above mentioned drawbacks.

According to the invention in a first aspect, a contactor for a motor vehicle starter, of the type comprising a cylindrical annular armature constituting a casing in which is mounted a winding which actuates a movable core in axial displacement, the movable core acting on a control rod which extends centrally through a fixed core in the form of a disc arranged at one of the axial ends of the armature, the contactor being further of the type in which the control rod controls displacements of a movable contact which is adapted to cooperate with two fixed contact terminals that form part of the power supply circuit for the motor of the said starter, the said fixed contact terminals being disposed in the base portion of a hood having the general form of a cylindrical pot, defining a skirt portion thereof which delimits a housing in which the movable contact is arranged, the contactor being further of the type which includes an electronic circuit for controlling the contactor, the said circuit comprising a support member, especially a printed circuit board, together with circuit components carried by the said support member, is characterised in that the electronic control circuit is disposed in an axial position in the interior of the hood of the contactor.

According to a preferred feature of the invention, the support member of the electronic control circuit is a disc having a central hole, with the body of the control rod extending through the said central hole, the said support member being disposed in an axial position between the fixed core and the movable contact. Preferably, the housing in the hood, in which the movable contact is disposed, is bounded axially by the base portion of the hood and by a plug member in the form of a disc, which is fixed in an axial position within the skirt portion of the hood, the said plug member having a central hole through which the control rod passes, while the skirt portion of the hood has an axial extension projecting beyond the plug member, whereby to define a cavity of generally cylindrical form in which the electronic control circuit is arranged.

With this last mentioned arrangement, when the contactor is in a rest position, the movable contact is preferably in axial engagement against a portion of the plug member in facing relationship with the movable contact.

The plug member preferably includes a central sleeve portion for guiding the control rod in sliding displacement therein.

According to a preferred feature of the invention, in the contactor having a plug member as defined above, the body of the plug member has at least one aperture through which certain components of the electronic control circuit, which extend axially within the cavity and housing of the movable contact, can pass.

A further preferred feature of the invention is that the body of the plug member has an aperture through which can pass pins for electrical connection, the said pins extending axially between the electronic control circuit and the base portion of the hood.

In preferred embodiments of this last mentioned arrangement, the connecting pins are embedded in the base portion of the hood, the latter being of an insulating material, with the said connecting pins extending axially, firstly within the hood towards the electronic control circuit, and secondly, outside the hood.

According to another preferred feature of the invention, the movable contact is made in the form of a rectangular plate, the lengthwise dimension of which is parallel to a diameter of the contactor, while the said aperture is offset radially with respect to a longitudinal edge of the movable contact.

According to yet another preferred feature of the invention, the free annular terminal edge of the portion of the skirt portion of the hood that is extended axially beyond the plug member bears axially against the fixed core.

In embodiments of the invention in which the support member of the electronic control circuit is a disc having a central hole through which the body of the control rod passes, the support member being disposed in an axial position between the fixed core and the movable contact, the support member is preferably soldered or welded on to an element of the said winding, the said element extending axially through the fixed core.

According to the invention in a second aspect, a motor vehicle starter is equipped with a contactor in accordance with the said first aspect of the invention.

Further features and advantages of the invention will appear more clearly on a reading of the following detailed description of a preferred embodiment of the invention, given by way of example only, and for an understanding of which reference is made to the accompanying drawings.

DESCRIPTION OF A PREFERRED EMBODIMENT OF THE INVENTION

Figure 1:
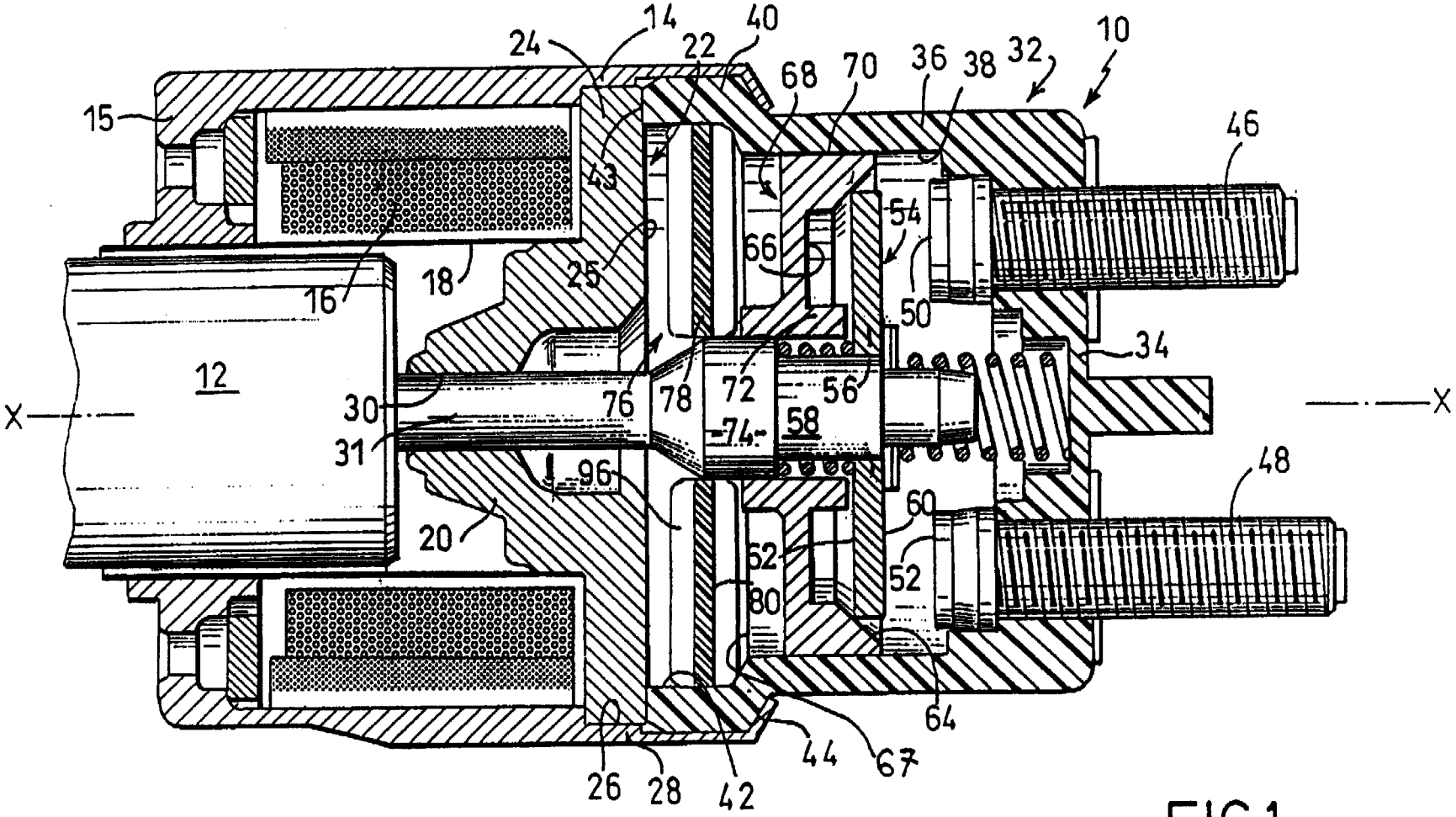
FIG. 1 is a view in axial cross section of a starter contactor made in accordance with the present invention.
Figure 2:
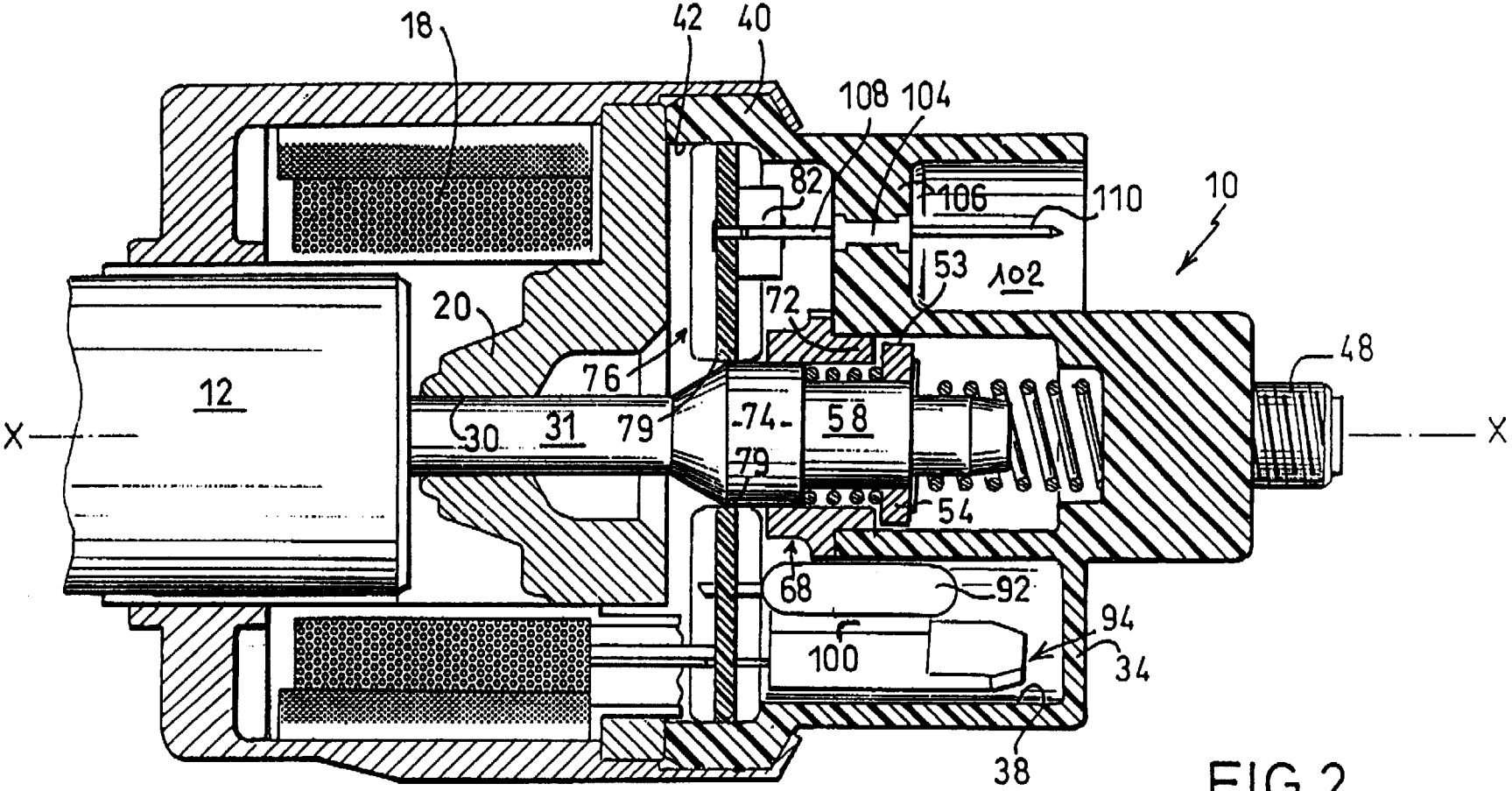
FIG. 2 is a view in axial cross section of the contactor shown in FIG. 1, the cross section of FIG. 2 being taken on a plane offset by 90 degrees with respect to the plane of the cross section in FIG. 1.

Reference is first made to FIGS. 1 and 2, which show an electromagnetic contactor 10 which is arranged for the equipment of a starter (not itself shown) for an internal combustion engine for a motor vehicle. The contactor 10 includes a movable core 12 which is connected to one end of a pivoting lever (not shown), the other end of which is connected to the driving element of the starter head.

The electromagnetic contactor 10 includes an external armature 14, which may also be referred to as a barrel or casing, and which is generally in the form of an annular cylinder having an axis X—X. An annular winding 16, in particular, is mounted within the external armature 14.

The movable core 12 is mounted for sliding movement within a tubular skirt 18 which is fixed on the central portion 20 of a fixed core 22. The fixed core 22 has the general form of a disc, the flat, annular main portion 24 of which, lying in a plane at right angles to the axis X—X, is fixed in a rebate 26 formed at the axial end 28 of the armature 14. The central portion 20 of the fixed core 22 is formed with a central hole 30 for guiding sliding movement of a control rod 31 along the axis X—X. The movable core 12 acts on the control rod 31.

The contactor 10 also includes a hood 32 which is made by moulding in an insulating material, for example a thermoplastic material. The hood 32 has the general form of a cylindrical pot, the axis of which is the axis X—X. It comprises a terminal radial base portion 34 extending at right angles to the axis X—X, together with a cylindrical lateral skirt portion 36. The main part of the skirt portion 36 defines a cylindrical internal housing 38, and its free end is defined by an end portion 40 of enlarged diameter, which bounds an internal cavity 42 of generally cylindrical form. The annular terminal edge 43 of the end portion 40 is in axial abutment against the facing surface 25 of the disc-shaped portion 24 of the fixed core 22.

The hood 32 is fixed sealingly on the armature 14 by radial inward seaming of an axial terminal portion 44, of reduced thickness, of the armature 14.

In a manner known per se, the contactor 10 includes a pair of fixed terminals of a suitable conductive material, indicated at 46 and 48. These terminals, which are part of the power supply circuit for the starter motor (not shown), are embedded in the base portion 34 of the hood 32 by moulding of the latter around them. Each terminal 46, 48 has a contact head 50, 52 respectively, and both of these contact heads lie in a plane at right angles to the axis X—X and within the housing 38.

Also in a manner known per se, the control rod 31 for the movable core 12 carries a movable contact 54 in the form of a rectangular plate, which has a central through hole 56 in which there lies a portion 58, of enlarged diameter, of the control rod 31.

In the rest position shown in FIG. 1, the core 12, the control rod 31 and the movable contact 54 are biassed elastically towards the left (with reference to FIG. 1) by a return spring, not shown, which is arranged between the movable core 12 and the radial terminal face 15 of the armature 14.

In the active position, that is to say when the winding 16 is energised, the movable core 12 and the control rod 31 displace the movable contact 54 from left to right (with reference to FIG. 1 ), until its contact face 60 establishes contact between the heads 50 and 52 of the fixed terminals 46 and 48 respectively.

In the embodiment of the invention shown in the drawings, the movable contact 54 bears, in the rest position, through its opposite radial face or abutment surface 62, against a conical portion 64 formed in facing relationship with the contact 54 in the radial face 66 of an intermediate plug member 68 which is generally in the form of a disc. The intermediate plug member 68 is made of a suitable insulating material and is fitted within the internal wall of the housing 38, with which the annular cylindrical surface 70 of the plug member 68 is in firm enough engagement to be gripped by the housing wall so that the plug member 68 is immobilised axially with respect to the skirt portion 36 of the hood 32.

The intermediate plug member 68 further includes, in its central part, a coaxial sleeve portion 72 for guiding a widened portion 74 of the control rod 31 in sliding movement within this sleeve portion. The radial face 67 of the intermediate plug member 60 which is opposite to its face 66 constitutes one boundary, in the axial direction, of the cavity 42.

An electronic circuit 76, including a support member 78, for controlling the contactor 10, is mounted within the cavity 42. In this connection reference is now made to FIGS. 3 and 4, in which the support member 78 consists of a printed circuit board in the form of a disc, which has a central hole 79 through which the widened portion 74 of the control rod 31 passes, as can be seen in FIGS. 1 and 2.

The printed circuit board 78 carries on that one of its radial surfaces, 80, that faces towards the intermediate plug member 68, various electrical and electronic circuit components. Among these latter are an electrical connector 82 which has four aligned female contacts, together with various resistors, capacitors and so on. The board 78 also carries an output terminal 84 for connection to ground potential, and an input terminal 86 for connection to the positive pole of the battery of the vehicle. A further output terminal 88 is connected to the common point of the winding 16 of the contactor, and a hole 90 is formed through the circuit board 78 so that the output end of the winding 16 can pass through the hole 90 for connection to the input terminal 46 or 48 connected to the positive pole of the battery.

Figure 3:
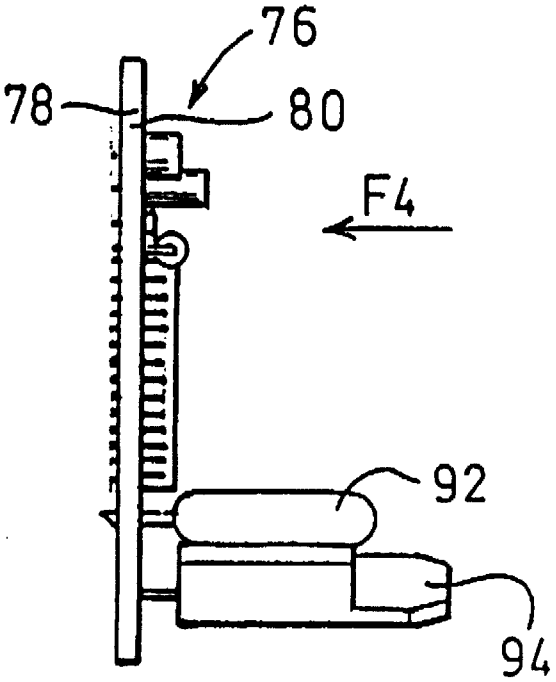
FIG. 3 is a side view of the electronic control circuit of the contactor shown in FIGS. 1 and 2, before it has been encapsulated within a protective layer.
Figure 4:
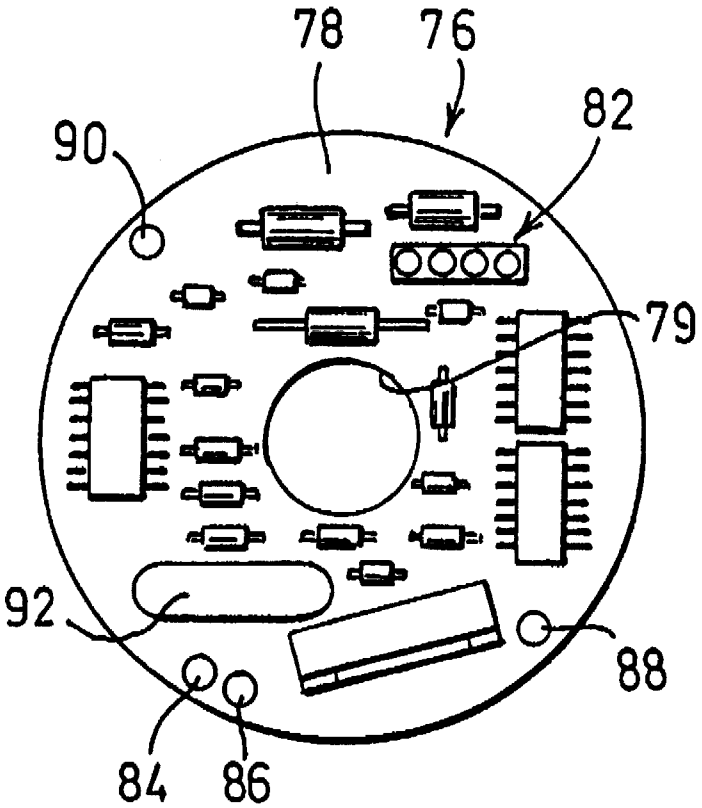
FIG. 4 is a view in the direction of the arrow F4 in FIG. 3.

As can best be seen in FIG. 3, some of the larger circuit components, 92 and 94, project axially from the radial surface 80 over a relatively large axial length.

A protective resin layer 96, shown in FIGS. 1 and 2, is moulded over the circuit board 78 and over the smaller circuit components mounted on the surface 80 of the latter. With reference specifically to FIG. 2, the electronic control circuit 76 is fixed on the contactor 10 by welding or soldering at 88 on to the output pin of the common point of the winding 16.

The electronic control circuit 76 is thus essentially disposed within the cavity 42, except for its larger components 92 and 94, which extend axially through an aperture 100 formed in the disc-shaped main portion of the intermediate plug member 68. This aperture 100 is offset radially outwardly with respect to the corresponding longitudinal edge 53 of the movable contact 54. The contact 54 is of a design known per se in which it is a rectangular plate, having two of these longitudinal edges 53 parallel to each other. The long components 92 and 94 thus extend axially beyond the plug member 68 and into the housing 38 which contains the movable contact 54.

The intermediate plug member 68 has a further aperture or slot 102 which is diametrically opposed to the aperture 100. The aperture 102 is again located radially outwardly of the corresponding edge 53 of the movable contact 54, and is open in the annular cylindrical edge surface 70 of the member 68. Four electrical connecting pins 104 extend through this aperture 102. The connecting pins 104 are embedded in an axially offset portion 106 of the base portion 34 of the hood 32. Each of the pins 104 has a first or inner portion 108 which extends axially towards the electronic control circuit 76, so as to be received in one of the female contacts of the connector 82. Each connecting pin 104 also has an outer portion 110, which extends outside the hood 32 so that it may be connected to an external connector not shown.

Thus, during the fitting of the sub-assembly which consists of the hood 32, the movable contact 54, the control rod 31 and the intermediate plug member 68, on to the other sub-assembly which consists essentially of the armature 14, the fixed core 22 and the electronic control circuit 76, the inner portions 108 of the connecting pins 104 are brought into direct mating connection within the female contacts of the connector 82 of the control circuit. In order to facilitate this assembly, it is of course possible to provide suitable indexing means (not shown), for setting the correct angular position of the hood 32 with respect to the armature 14.

During the fitting of these two sub-assemblies together, the control rod 31, 72 passes through the electronic control circuit 76 via the central hole 79 in the printed circuit board 78, with the control rod 31 subsequently passing conventionally through the hole 30 in the fixed core 22 so as to come into cooperating engagement with the movable core 12.

It will be understood that, in a contactor designed according to the present invention, the electronic control circuit no longer requires the provision of an independent casing for fitting on the vehicle. The electronic control circuit 76 is protected against splashing by water, and against corrosion, by the means inherent in the contactor itself which seal the latter.

Also, the external electrical connections between the electronic control circuit and the contactor have been eliminated.

The hood 32 of the contactor 10 retains its conventional form which is generally that of a cylindrical pot, while the various elements that are provided for electrical connection purposes are unchanged. Indeed, most of the components of a contactor according to the state of the current art are preserved.

Finally, the axial overall length of the contactor 10 of the invention is only very slightly increased as compared with that of a conventional contactor having an external electronic control circuit.

What is claimed is:

1. A contactor, for a motor vehicle starter having a starter motor and a power supply circuit for said motor, the said power supply circuit including a pair of fixed contact terminals, the contactor comprising: an annular cylindrical armature constituting a casing; a movable core mounted in the said armature for axial movement therein; a winding within the said casing for effecting said axial movement of the movable core; a disc-shaped fixed core disposed at one axial end of the said armature and having a central axial hole; a control rod extending through the said axial hole in the fixed core into contact with the said movable core, so as to be displaceable by the latter; a hood having the general form of a cylindrical pot and including a skirt portion which defines a housing internally of the hood, the hood further including a base portion joined to its said skirt portion, the said fixed contact terminals being arranged in the said base portion of the hood; a movable contact disposed within the said housing and coupled with the said control rod for displacement of the movable contact by the control rod into and out of electrical contact with the said pair of fixed contact terminals; and an electronic control circuit for the contactor, the said control circuit comprising a support member and circuit components carried by the support member, wherein the said control circuit is disposed in an axial position within the said hood.

2. A contactor according to claim 1, wherein the said support member is a disc having a central hole, the control rod having a body portion extending through the said central hole in the support member of the said control circuit, the said support member being disposed in an axial position intermediate between the fixed core and the movable contact.

3. A contactor according to claim 2, further including a disc-shaped plug member fixed in an axial position within the said skirt portion of the hood, the said base portion of the hood and the said plug member together delimiting the said housing axially, the said plug member having a central hole, the control rod extending through the central hole in the plug member, the skirt portion of the hood having an axial extension portion extending beyond the plug member and defining a generally cylindrical cavity, the electronic control circuit being disposed within the said cavity.

4. A contactor according to claim 3, wherein the plug member includes a portion thereof in facing relationship axially with the movable contact, the movable contact being so disposed that in a rest position of the contactor, the movable contact is in axial engagement with the said portion of the plug member.

5. A contactor according to claim 3, wherein the plug member includes a central sleeve portion for guiding sliding movement of the control rod therein.

6. A contactor according to claim 3, wherein the plug member comprises a body having at least one through aperture, the electronic control circuit including circuit components extending through the said at least one aperture and into the said cavity and housing.

7. A contactor according to claim 3, wherein the plug member comprises a body having a through aperture therein, the contactor further including electrical connecting pins extending axially between the said control circuit and the base portion of the hood, the said pins extending through the said aperture in the body of the plug member.

8. A contactor according to claim 7, wherein the hood is of an insulating material, with the said connecting pins being embedded in the base portion of the hood and extending axially, firstly within the hood towards the control circuit, and secondly outside the hood.

9. A contactor according to claim 7, wherein the movable contact comprises a rectangular plate defining a length thereof parallel to a diameter of the contactor, the plug member having at least one through aperture therein, said at least one aperture including the said aperture through which the said electrical connecting pins pass, with said at least one aperture being offset radially with respect to a longitudinal edge of the said plate.

10. A contactor according to claim 1, wherein the skirt portion of the hood includes an end portion defining a free annular terminal edge thereof, the contactor further including a disc-shaped plug member fixed axially within the said skirt portion, the said end portion of the skirt portion extending the latter axially beyond the plug member and being in axial engagement against the fixed core.

11. A contactor according to claim 2, wherein the said winding includes an element extending axially through the fixed core and soldered to the support member of the electronic control circuit.

12. A motor vehicle starter equipped with a contactor according to claim 1.

* * * * *